United States Patent [19]

Bossuet et al.

[11] Patent Number: 4,728,961

[45] Date of Patent: Mar. 1, 1988

[54] ELECTROMAGNETIC WAVE SPATIAL FILTER WITH CIRCULAR POLARIZATION AND A CASSEGRAIN ANTENNA COMPRISING SUCH A FILTER

[75] Inventors: Patrice Bossuet, Herblay; Francois Gautier, Boulogne-Billancourt, both of France

[73] Assignee: Thomson-CSF, Paris, France

[21] Appl. No.: 913,127

[22] Filed: Sep. 29, 1986

Related U.S. Application Data

[62] Division of Ser. No. 573,399, Jan. 24, 1984, Pat. No. 4,652,891.

[30] Foreign Application Priority Data

Jan. 31, 1983 [FR] France ..... 83 01451

[51] Int. Cl.[4] ..... H01Q 19/00

[52] U.S. Cl. ..... 343/756; 343/909

[58] Field of Search ..... 343/756, 909; 333/21 R, 333/21 A

[56] References Cited

U.S. PATENT DOCUMENTS

| | | | |
|---|---|---|---|
| 4,266,203 | 5/1981 | Saudreau et al. | 343/756 |
| 4,387,377 | 6/1983 | Kandler | 343/756 |
| 4,479,128 | 10/1984 | Brunner et al. | 343/756 |

*Primary Examiner*—William L. Sikes
*Assistant Examiner*—Robert E. Wise
*Attorney, Agent, or Firm*—Roland Plottel

[57] ABSTRACT

A spatial filter is provided for electromagnetic waves with circular polarization comprising three parallel conducting networks, the central network being totally reflecting for a rectilinear polarization of given direction and having a non zero reflection coefficient for a rectilinear polarization having a direction perpendicular to the preceding one.

6 Claims, 5 Drawing Figures

ELECTROMAGNETIC WAVE SPATIAL FILTER WITH CIRCULAR POLARIZATION AND A CASSEGRAIN ANTENNA COMPRISING SUCH A FILTER

This application is a division of application Ser. No. 573,399, filed 1-24-84 now U.S. Pat. No. 4,652,891.

BACKGROUND OF THE INVENTION

1. Field of the Invention

The present invention relates to an electromagnetic microwave wave spatial filter with circular polarization. On particularly interesting use of such a filter is the construction of an antenna of the Cassegrain type with a primary source emitting circularly polarized waves.

2. Description of the Prior Art

A filter with circular polarization must be definition have the following properties: be transparent for the incident waves transmitted with a given circular polarization and be reflected for incident waves transmitted with a reverse circular polarization.

According to a first embodiment existing at the present time, a circular polarization filter is formed of five networks of wires, shown in FIG. 1, the description and operating principle of which will be explained in what follows.

The filter comprises five networks 1 to 5, parallel to each other, centered on the same axis Δ and formed of parallel conducting wires. The first two networks 1 and 2 as well as the last two 4 and 5 are separated by dielectric spacers 8 and 9 of a given thickness $e_1$. These dielectric spacers serve both as support for the networks and as a path of given length for the waves transmitted between these networks. For these four networks 1, 2, 4 and 5, the pitch $d_1$ is close to a quarter of a wave length at the central frequency of the operating band. With respect to a reference system defining the incidence angle and the polarization of the incident wave and formed by two orthogonal axes OX and OY whose origin O is situated on the axis Δ and perpendicular to this latter, the wires 6 of these four networks are parallel to the same direction forming an angle of 45° with the direction of the wires of network 3. These networks have a self-inductive reflection coefficient for the component of the field parallel to the wires:

$$r_1 = \tfrac{1}{2}(j-1)$$

j being the imaginary number such that $j^2 = -1$ and $r_1 = 0$ for the component of the field perpendicular to the wires.

In the particular case of the graphic representation of FIG. 1, the wires 6 are parallel to a direction forming an angle of 45° with the axes OX and OY.

The third network 3 is parallel to the preceding ones and situated between the networks 2 and 4. The pitch $d_2$ of the parallel metal wires 7 which form it and which are parallel to the direction of the reference axis OY is very much less than λ/4, so that this network 3 has a reflection coefficient $r_2 = -1$ for the component of the field parallel to wires 7 and $r_2 = 0$ for the component of the field perpendicular to the wires.

The first assembly formed of the first two networks 1 and 2 separated by the dielectric web 8 play the role of a circular polarizer transforming the circular polarization of the incident waves into a rectilinear polarization. This rectilinear polarization is orientated at 45° with respect to wires 6. The central network 3 with closely spaced pitch plays the role of rectilinear polarization filter, transparent for a rectilinear polarization perpendicular to the direction of wires 7 and totally reflecting for rectilinear polarization parallel to their direction. Finally, the second assembly formed by the last two networks 4 and 5 separated by the dielectric web 9 serves as polarizer, transforming the rectilinear polarization of the waves transmitted by the preceding filter into a circular polarization.

The operation of the circular polarization filter which has just been described is for example as follows.

There will be obtained, at the output of the first circular polarizer a rectilinear polarization with direction parallel to axis OY for an incident left hand circular polarization for example and a rectilinear polarization with direction parallel to axis OX for an incident right hand circular polarization. Then, the incident wave whose circular polarizatin directin is such that the first polarizaer transforms it into a wave with rectilinear polarization with direction parallel to the wires 7 of the rectilinear polarization filter is totally reflected thereby and passes through the first polarizer in the reverse direction which retransforms it into a circular polarization wave of the same direction. On the other hand, the reverse circular polarisation incident wave is transmitted by the filter with a rectilinear polarization whose direction is perpendicular to the wires 7 of the filter. It is finally transformed again by the second polarizer into a wave with right hand circular polarization.

Thus, depending on the orientation of the wires 7 of the central network 3 with closely spaced pitch, the overall filter is only transparent for a left or right hand circular polarization.

A second known construction of a circular polarization filter is described in the French patent filed on Dec. 30th 1966 in the name of the applicant and published under the numer 1 512 598. This filter, shown in FIG. 2 is formed by a network 10 of resonating elements 11, each element being formed by a metal wire bent into three sections 12, 13, 14 perpendicular to each other, in the form of "cranks".

These two embodiments have the disadvantage of being difficult to construct, the first because of the number of elements to be formed and assembled leading to a heavy solution from the mechanical point of view, the second because of the three dimensional wire network.

SUMMARY OF THE INVENTION

The circular polarization filter, forming the subject of the invention, aims at resolving this problem. For that, it comprises two parallel conducting networks and a third central conducting network, parallel to the first two networks, placed therebetween and separated from each of them by a dielectric spacer totally reflecting for a rectilinear polarization of given direction and having a non zero reflection coefficient for a rectilinear polarization whose direction is perpendicular to the preceding one.

According to one feature of one embodiment of the invention, the third central network is formed of two networks of conducting wires, one being formed of parallel wires whose direction forms an angle of 45° with that of the wires of the first two networks and whose pitch is close to a quarter of the wave length λ at the central frequency of the operating band and the other being formed from parallel wires whose direction is orthogonal to the preceding one and whose pitch is very much less than $\lambda/4$. In another embodiment, the central network comprises a suitably slotted plate.

BRIEF DESCRIPTION OF THE DRAWINGS

Other features and advantages of the invention will appear from the following description, illustrated by the figures which, apart from FIGS. 1 and 2 already described showing two filter constructions of the prior art, show.

DESCRIPTION OF THE PREFERRED EMBODIMENTS

Before describing the circular polarization filter of the invention, we refer again to the filter of the prior art comprising five conducting networks. It can be shown mathematically that the assembly formed by the three networks of the center 2, 3 and 4 have the two following radioelectric properties:

it is totally reflecting for a rectilinear polarization with direction parallel to wires 7 of the central network 3 with closely spaced wires, it has a non zero reflection coefficient for a rectilinear polarization with direction perpendicular to wires 7 of network 3. This reflection coefficient is due to the presence of networks 2 and 4 and equal to $r_1$.

The solution proposed by the invention consists in replacing the assembly of these three conducting networks by a single network having the same radioelectric properties.

Figure 3:
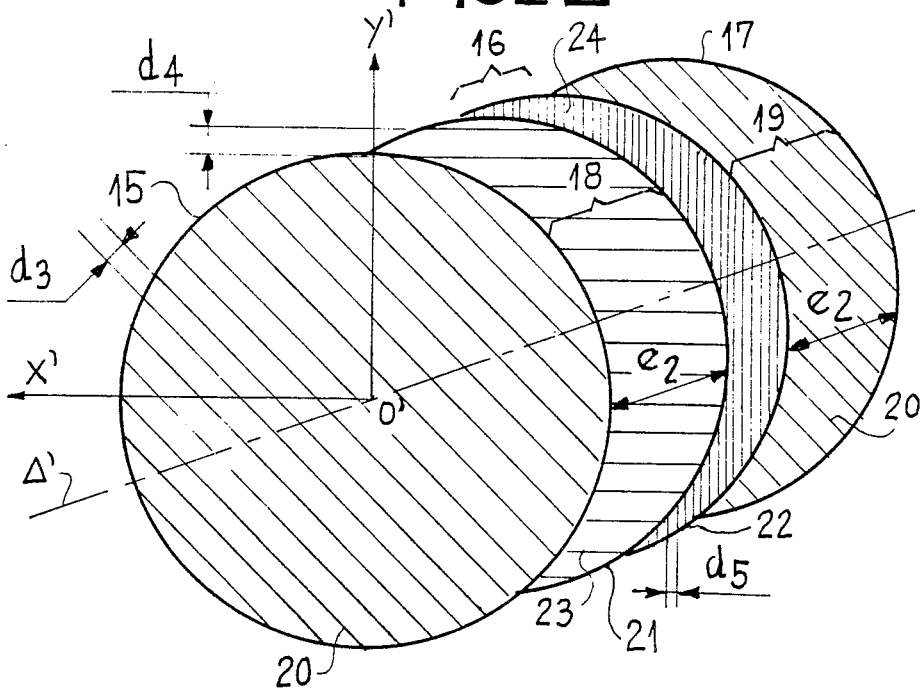
FIGS. 3 and 4: two embodiments of a circular polarization filter in accordance with the invention.

According to the example shown in FIG. 3, the circular polarization filter of the invention comprises three parallel conducting networks 15, 16 and 17 and two dielectric spacers 18 and 19.

As before, a reference system is defined with three orthogonal axes $\Delta'$ and OX' and OY' with origin O.

The two networks 15 and 17 are formed from conducting wires 20 parallel to the same direction. The pitch of these networks 15 and 17 is close to $\lambda/4$. The central network 16 is placed between these two endmost networks and is separated therefrom on each side by the two dielectric webs of thickness $e_2$. This central network, which has the above described radioelectric properties, may be formed for example from two networks 21 and 22 of parallel conducting wires. One of them 21 is a network of parallel wires 23 whose pitch $d_4$ is close to $\lambda/4$ and whose direction is orthogonal to that of the parallel wires 24 of the other network 22. This latter has a very closely spaced pitch $d_5$, less than $\lambda/4$. The wires 20 of the two networks 15 and 17 have a direction forming an angle $\alpha$ of 45° with those of wires 23 and 24 of the two respective imbricated networks 21 and 22.

Actually, it is very difficult in practise to construct such a central network 16 formed from two networks of imbricated wires while avoiding any coupling therebetween. To get round this difficulty, the central network 16 may be formed preferably from a double face printed circuit, each of the two networks 21 and 22 being deposited on one of the two faces, opposite each other, by photoetching for example, their respective wires 23 and 24 being perpendicular but without contact therebetween.

Figure 4:
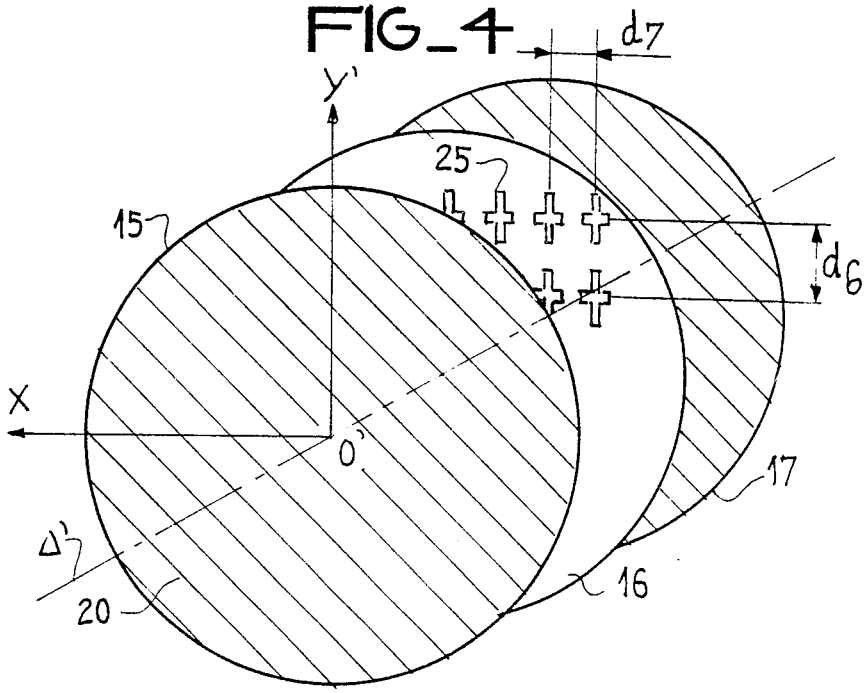

In FIG. 4 is shown another emboidment of a central network 16 having the two above described radioelectric properties. It is a conducting network with resonating slots 25 in the form of a cross, whose dimensions and spacing are determined so as to obtain these properties. Their dimensions are such that these slots are equivalent to the two imbricated orthogonal networks of parallel wires. The spacings $d_6$ and $d_7$ between the adjacent crosses 25 are respectively of the order $\lambda/2$ for $d_6$ and very much less than $\lambda/4$ for $d_7$.

According to another embodiment, the central conducting network 16 may be pierced with antenna of a special shape, still having the same radioelectric properties.

In so far as the operating conditions are conderned, this filter operates correctly in the presence of plane waves for dimensions of at least $5\lambda$. It is selective in frequency—a few per cent—and in incidence.

Figure 1:
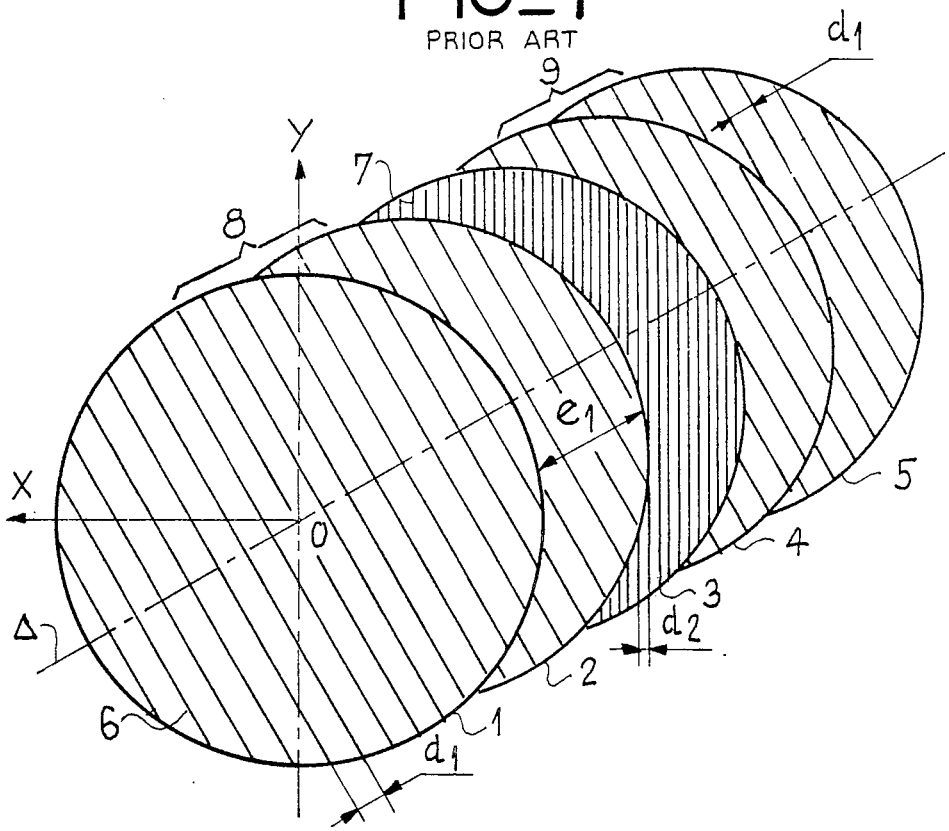
FIG 1 PRIOR ART
Figure 2:
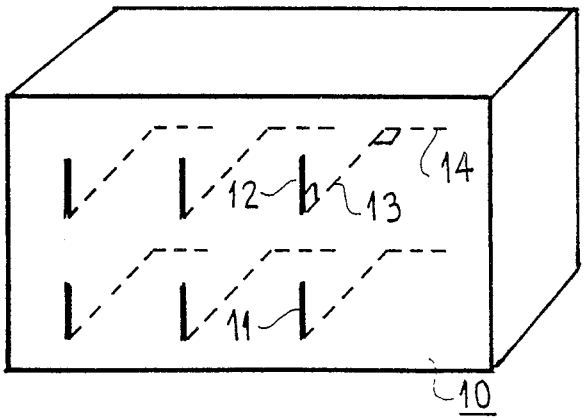
FIG 2 PRIOR ART
Figure 5:
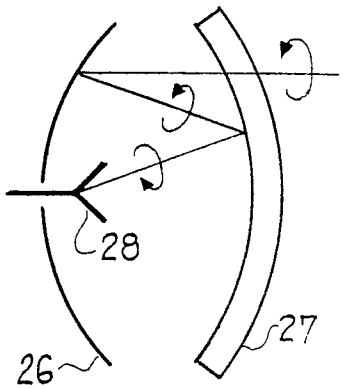
FIG. 5: a Cassegrain antenna using a polarization filter according to the invention.

A particularly interesting application of this filter is the construction of a Cassegrain antenna whose primary source radiates waves with circular polarization. In FIG. 5 is shown schematically such an antenna comprising a main reflector 26, an auxiliary reflector 27 and a circularly polarized wave source 28. The auxiliary reflector 27 is formed by a circular polarization filter according to the invention, reflecting totally the polarization of the incident waves emitted by source 28 but transparent for the reverse polarization reflected by the main reflector 26.

What is claimed is:

1. A spatial filter comprising first and second parallel grids (15,17) disposed on opposite sides of said filter; first and second dielectric layers (18,19) disposed between said grids; and a central network (16) between said dielectric layers participating with the said first grids and said first dielectric layer for conversion of incident circularly polarized waves into lineary polarized waves and with said second grids and said second dielectric layer for conversion of lineary polarized waves to circulatory polarized waves, said central network being totally reflecting for lineary polarized waves of a first polarization and transparent for waves of a second polarization perpendicular to said first polarization, wherein said two grids are each formed from conducting wires parallel to a same direction and having a pitch close to a quarter of the wave length $\lambda$ at the central frequency of the operating band of said filter; and said central network is formed from two networks of conducting wires, the first of said two networks comprising parallel wires having a pitch close to $\lambda/4$, the second of said two networks comprising parallel wires having a closely spaced pitch less than $\lambda/4$, and with a direction perpendicular to that of the wires forming said first network, the direction of the wires of said two grids forming an angle of 45° with those of the wires of said two respective networks.

2. A filter as claimed in claim 1, wherein said central network is formed from a double face printed circuit, each of said two networks forming it being deposited on one of the faces, opposite each other, of this printed circuit.

3. A spatial filter comprising first and second parallel grids (15,17) disposed on opposite sides of said filter; first and second dielectric layers participating with the said first grid and said first dielectric layer for conversion of incident circularly polarized waves into lineary polarized waves and with said second grid and said second dielectric layer for converstion of lineary polarized waves to circulary polarized waves; said central network being totally reflecting for lineary polarized waves of a first polarization and transparent for waves of a second polarization perpendicular to said first polarization, and said central network consisting of an assembly of no more than two network members extending across the path of the incident waves of which at least one member of the assembly between the first and second grids serves to cooperate with the first parallel grid and first dielectric layer to convert the incident circularly polarized waves to linearly polarized waves and also with the second grid, with the second dielectric layer and with any second member to pass linearly polarized waves of one direction and to reflect linearly polarized waves of the direction perpendicular to the first direction.

4. A filter as in claim 3 in which the first and second parallel grids are each formed of conducting wires parallel to the same direction and having a pitch close to a quarter of the wavelength at the central frequency of the operating band of the filter in which the assembly of the central network consists of a first member comprising a grid of conducting parallel wires having the same pitch as the first and second grids and a second member of conducting parallel wires having a pitch less than that of the first member and direction perpendicular to that of the wires forming the grid of the first member, the directions of the wires of the first and second parallel grids forming an angle of 45° with those of the grids of the first and second members.

5. A filter as in claim 4 in which the grids of the first and second members are formed from a double-face printed circuit, the respective grids being deposited on opposite faces of the printed circuit.

6. A filter as in claim 3 wherein the assembly of said central network comprises a member having a plurality of resonating slots in the form of a cross and in which the spacings between adjacent slots in one direction are approximately one-half of the wavelength of the central frequency of the operating band and the spacings between adjacent slots in the direction perpendicular to the one directin ar less than one-quarter of said wavelength.

* * * * *